US007248815B2

(12) United States Patent
Chang

(10) Patent No.: US 7,248,815 B2
(45) Date of Patent: Jul. 24, 2007

(54) FITTING PROTECTING APPARATUS OF DEVELOPER CARTRIDGE AND IMAGE FORMING APPARATUS HAVING THE SAME

(75) Inventor: Deuk-hwan Chang, Suwon-si (KR)

(73) Assignee: Samsung Electronic Co., Ltd., Suwon-si, Gyeonggi-do (FR)

( * ) Notice: Subject to any disclaimer, the term of this patent is extended or adjusted under 35 U.S.C. 154(b) by 261 days.

(21) Appl. No.: 11/036,101

(22) Filed: Jan. 18, 2005

(65) Prior Publication Data

US 2006/0018685 A1 Jan. 26, 2006

(30) Foreign Application Priority Data

Jul. 22, 2004 (KR) ..... 10-2004-0057372

(51) Int. Cl.
*G03G 15/22* (2006.01)

(52) U.S. Cl. ..... 399/114

(58) Field of Classification Search ..... 399/238, 399/114, 263, 237

See application file for complete search history.

(56) References Cited

U.S. PATENT DOCUMENTS 5,083,158 A * 1/1992 Kashima et al. ..... 399/114
5,686,985 A * 11/1997 Hayashi ..... 399/222
5,729,796 A * 3/1998 Miura et al. ..... 399/114
5,974,287 A * 10/1999 Kurz et al. ..... 399/114
6,438,345 B1 * 8/2002 Ban et al. ..... 399/262
2005/0201777 A1 * 9/2005 Konishi ..... 399/114
2005/0238389 A1 * 10/2005 Kim et al. ..... 399/238
2006/0062601 A1 * 3/2006 Jeong ..... 399/238

FOREIGN PATENT DOCUMENTS

JP 2003-200592 7/2003
JP 2003-326734 11/2003
KR 1019950034299 10/1995
KR 1019960017517 5/1996

* cited by examiner

*Primary Examiner*—Anjan Deb
(74) *Attorney, Agent, or Firm*—Roylance, Abrams, Berdo & Goodman, L.L.P.

(57) ABSTRACT

A fitting protecting apparatus of a developer cartridge includes a housing storing liquid developer. The housing has at least one connection fitting connected to an outside corresponding connection fitting. A cover part is movably disposed between a first position of sealing the connection fitting to prevent exposure and a second position of opening the connection fitting to provide access thereto. The cover part is disposed in the housing. An operation part moves the cover part between the first and second positions. When a developer cartridge is taken out of a main body of an image forming apparatus or while being stored, the connection fitting connected to the outside corresponding connection fitting is covered, thereby preventing developer exposure through the connection fitting, pollution of the connection fitting by alien substances, such as dust, and damage of the connection fitting by external collisions.

24 Claims, 7 Drawing Sheets

FITTING PROTECTING APPARATUS OF DEVELOPER CARTRIDGE AND IMAGE FORMING APPARATUS HAVING THE SAME

CROSS-REFERENCE TO RELATED APPLICATIONS

This application claims the benefit under 35 U.S.C. § 119(a) of Korean Patent Application No. 2004-57372 filed on Jul. 22, 2004 in the Korean Intellectual Property Office, the entire content of which is hereby incorporated by reference.

BACKGROUND OF THE INVENTION

1. Field of the Invention

The present invention generally relates to an image forming apparatus, such as a wet-type electrophotographic printer, using liquid developer. More particularly, the present invention relates to a fitting protecting apparatus of a developer cartridge for protecting a connection fitting of a developer cartridge for storing and supplying liquid developer, and to an image forming apparatus having the same.

2. Description of the Related Art

An image forming apparatus, such as a wet-type electrophotographic printer, typically includes a developer supply system for supplying liquid developer to a developing part. The developer supply system may be either a one-body type in which a developer cartridge is formed in one body with a developing part, and a separation type in which a developer cartridge is separated from a developing part through a connection with a connection tube.

In a separation type developer supply system, liquid developer is supplied from a developer cartridge to a developing part and is recollected from the developing part to the developer cartridge through a connection tube by using a developer supply pump and/or a developer re-collection pump. The developer cartridge is connected to the connection tube through a coupling part such as a fitting.

FIG. 1 schematically illustrates a general wet-type electrophotographic printer 10 employing a separation type developer supply system.

Referring to FIG. 1, the wet-type electrophotographic printer 10 includes an image forming part 11 and a developer supply part 21.

The image forming part 11 includes a photoconductive body 1, such as an OPC drum (Organic Photoconductive Drum), a laser scanning part 33, a charge part 6, an antistatic part 7, a developing part 26 and a cleaning blade 8. These components mutually work and provide a desired image to the photoconductive body 1 through sequential image formation procedures such as charge, discharge, and exposure and developing procedures.

The developing part 26 includes a developing chamber 27 through which liquid developer 48 flows, a developing roller 2 disposed under the photoconductive body 1, a deposit roller 5 for applying electric force to the liquid developer 48 to form a charged developer layer around the developing roller 2, a metering roller 3 for limiting the charged developer layer formed around the developing roller 2 by the deposit roller to a predetermined toner volume or density (percent solid) and to supply the charged developer layer to a nip between the developing roller 2 and the photoconductive body 1, a cleaning roller 4 for cleaning the developing roller 2, and a recollection chamber 28 for recollecting liquid developer 48 overflowing from the developing chamber 27.

A developer supply part 21 is disposed to supply liquid developer 48 to a developing chamber 27 of the developing part 26.

The developer supply part 21 includes a developer cartridge 50 for storing liquid developer 48, first and second connection tubes 22 and 23 for connecting the developer cartridge 50 to a developing chamber 27 of a developing part 26, a developer supply pump 18 disposed between the first and second connection tubes 22 and 23, a developer recollection pump 19 disposed between third and fourth connection tubes 20 and 24, and a controller 29 for controlling motors of the developer supply pump 18 and the developer recollection pump 19.

With reference to FIG. 2, the developer cartridge 50 includes a housing 12 provided as a developer storage space for storing liquid developer 48, and a liquid developer agitator 35 for agitating the liquid developer 48 within the housing 12.

On an upper part of the housing 12, a first developer discharge part 17 and a first developer influx part 16 are installed. The first developer discharge part 17 is connected to a second developer influx part 13 of a developing chamber 27 of a developing part through first and second connection tubes 22 and 23, to supply liquid developer 48 of a housing 10 to the developing chamber 27. The first developer influx part 16 is connected to a second developer discharge part 14 of a recollection chamber 28 of the developing part 26 through third and fourth connection tubes 20 and 24, to recollect the liquid developer 48 from a recollection chamber 2.

The first developer discharge part 17 includes a first female fitting 17*a*, a developer suction tube 40, and a first male fitting 17*b*. The first female fitting 17*a* is disposed on the housing 12. The developer suction tube 40 is extended from the first female fitting 17*a* to the bottom of the housing 12. The first male fitting 17*b* is disposed at the end of the first connection tube to couple with the first female fitting 17*a* when the housing 12 is accommodated in a printer body (not shown).

The first developer influx part 16 includes a second female fitting 16*a* and a second male fitting 16*b*, as in the first developer discharge part 17. A configuration of the second female fitting 16*a* and the second male fitting 16*b* is the same as the construction of the first female fitting 17*a* and the first male fitting 17*b*, except that the suction tube 40 is not connected to the second female fitting 16*a*.

However, by a structural characteristic of such a conventional wet-type printer 10, when a developer cartridge 50 is separated from the printer body for maintenance or when the developer cartridge is not installed in the printer body, a first female fitting 17*a* of a first developer discharge part 17 and a second female fitting 16*a* of a first developer influx part 16 are exposed. Developer stains on portions of the exposed first and second female fittings 17*a* and 16*a* are exposed to a user, and portions of the exposed first and second female fittings 17*a* and 16*a* may become polluted by outside foreign substances, such as dust and the like, or portions of the first and second female fittings 17*a* and 16*a* exposed in handling the developer cartridge 50 may be damaged by falling or an external collision.

In situations where developer stains on portions of the exposed first and second female fittings 17*a* and 16*a* are exposed to a user, the user may be further transfer such developer and secondarily pollute or stain other components of the printer.

When portions of the exposed first and second female fittings 17*a* and 16*a* are polluted with foreign substances, it is inconvenient to remove the foreign substances adhering on the portions of the polluted first and second female fittings 17*a* and 16*a* before installing the developer cartridge 50 in the printer body. Furthermore, if the developer cartridge 50 is installed in the printer body in a state that the foreign substances are not completely removed, the foreign substances may flow in the liquid developer 48, thus polluting the liquid developer 48 and lowering the quality of the image formed by a developing part 26.

Also, if portions of the exposed first and second female fittings 17*a* and 16*a* are damaged by outside collision, a sealing state between a first female fitting 17*a* and a first male fitting 17*b* of a first developer discharge part 17 and between a second female fitting 16*a* and a second male fitting 16*b* of a first developer influx part 16 is not optimal, thus causing leakage of liquid developer 48 and polluting its periphery.

Thus, a need exists for a fitting protecting apparatus for a developer cartridge of an image forming apparatus that protects a connection fitting of the developer cartridge that stores and supplies liquid developer.

SUMMARY OF THE INVENTION

Accordingly, it is an aspect of the present invention to provide a fitting protecting apparatus of a developer cartridge and an image forming apparatus having the same, which are capable of preventing a connection fitting of a developer cartridge connected to the outside to supply liquid developer, from being exposed, thereby being susceptible to being polluted and damaged.

According to an aspect of the invention, a fitting protecting apparatus of a developer cartridge includes a housing that stores liquid developer and that has at least one connection fitting connected to an outside corresponding connection fitting. A cover part is movably disposed between a first position of sealing the connection fitting to not be exposed when not connected and a second position of opening a connection fitting, the cover part being disposed in the housing. An operation part moves the cover part between the first and second positions.

The cover part according to an exemplary embodiment of the invention is constructed of a cover member covering a connection fitting. A support member supports the cover member to the housing so that the cover member rotatably moves between the first position and the second position. The cover member may be constructed of a plate larger than a flat area of a connection fitting, and the support member may be desirably constructed of a support axis fixed to the housing. A support axis hole is formed in the cover member and is adapted to receive and support the support axis.

The operation part is constructed of a pinion gear formed in one end part of the cover member. A rack member has a rack gear engaging the pinion gear, thereby rotatably moving the cover member.

The rack member may be substantially immovably fixed to a main body of an image forming apparatus. That is, when the housing is installed in or taken out of the main body of the image forming apparatus, the rack member rotatably moves the cover member between the first and second positions by rotatably moving the pinion gear engaging the rack gear through use of a movement force of the housing.

The rack member may be installed to move in the housing, instead of being fixed to the main body. In this case, the rack member moves by a force applied by a user when an outside corresponding connection fitting is connected to or disconnected from a connection fitting of the housing, thus a pinion gear engaging with a rack gear moves rotatably, thereby rotatably moving the cover member between first and second positions.

Selectively, the operation part may be constructed of a protrusion formed in one end part of the cover member, and a corresponding protrusion member that engages with the protrusion, thereby rotatably moving the cover member.

The fitting protecting apparatus of the invention may further include a return part for returning the cover member of the cover part from a second position to a first position when the housing is taken out of a main body of an image forming apparatus or when the outside corresponding connection fitting is disconnected from a connection fitting of the housing.

The return part is constructed of an elastic spring which is installed in the housing and of which one end part is supported by a first support boss formed in the housing and another end part is supported by a second support boss formed in the cover member.

Selectively, the return part may be constructed of an elastic spring which is installed in the support member of the cover part and of which one end part is supported by a first support boss formed in the housing and another end part is supported by a second support boss formed in the cover member.

The fitting protecting apparatus of the invention may further include an exterior cover member that is installed in the housing to prevent exposing the cover part and the return part when outside. The exterior cover member has an aperture exposing a connection fitting in the outside so that an outside corresponding connection fitting is connected to a connection fitting.

According to another aspect of the invention, an image forming apparatus includes an image forming part having a developing part forming an image by using liquid developer. A developer cartridge has a housing that has at least one connection fitting connected to a corresponding connection fitting of at least one connection tube that is connected to the developing part so as to supply liquid developer to the developing part. The developer cartridge includes a cover part disposed in the housing to be moved between a first position of sealing a connection fitting to prevent being exposed and a second position of opening a connection fitting. A fitting protecting part has an operation part for moving the cover part to the second position when an outside corresponding fitting is connected to a connection fitting of the housing and that covers a connection fitting.

The cover part according to an exemplary embodiment of the invention, is constructed of a cover member covering a connection fitting, and a support member supporting the cover member to the housing so as to rotatably move the cover member between a first position and a second position. The cover member may be constructed of a plate larger than a flat area of a connection fitting, and the support member may be constructed of a support axis fixed to the housing. A support axis hole is formed in the cover member, and is adapted to receive and support the support axis.

The operation part is constructed of a pinion gear formed in one end part of the cover member; and a rack member having a rack gear engaging the pinion gear, thus rotatably moving the cover member.

The rack member may be substantially immovably fixed to a main body. That is, when the developer cartridge is installed in or taken out of the main body, the rack member rotatably moves the cover member between the first and second positions by rotatably moving the pinion gear engaging the rack gear through use of a movement force of the housing.

The rack member may be installed to move by a predetermined distance in the housing, instead of being fixed to the main body. In this case, the rack member moves by an external force when an outside corresponding connection fitting is connected to or disconnected from a connection fitting of the housing, thereby rotatably moving a pinion gear engaging a rack gear to rotatably move the cover member between first and second positions.

Selectively, the operation part may be constructed of a protrusion formed in one end part of the cover member, and a corresponding protrusion member that engages the protrusion, thereby rotatably moving the cover member.

The fitting protecting part of the invention may further include a return part returning the cover member of the cover part from a second position to a first position when the developer cartridge is taken out of a main body of an image forming apparatus or when the outside corresponding connection fitting is disconnected from a connection fitting of the housing.

The return part is constructed of an elastic spring that is installed in the housing and of which one end part is supported by a first support boss formed in the housing and another end part is supported by a second support boss formed in the cover member.

Selectively, the return part may be constructed of an elastic spring that is installed in the support member of the cover part and of which one end part is supported by a first support boss formed in the housing and another end part is supported by a second support boss formed in the cover member.

The fitting protecting part of the invention further includes an exterior cover member that is installed in the housing prevent exposing the cover part and the return part. The exterior cover member has an aperture exposing a connection fitting in the outside so that an outside corresponding connection fitting is connected to a connection fitting.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above aspects and features of the present invention will be more apparent by describing certain embodiments of the present invention with reference to the accompanying drawings, in which.

Throughout the drawings, like reference numerals will be understood to refer to like parts, components and structures.

DETAILED DESCRIPTION OF EXEMPLARY EMBODIMENTS

Exemplary embodiments of the invention are more fully described in detail with reference to FIGS. 3 through 7. The invention may be embodied in many different forms and should not be construed as being limited to the exemplary embodiments set forth herein. Rather, these exemplary embodiments are provided so that this disclosure is thorough and complete, and to convey the concept of the invention to those skilled in the art.

According to exemplary embodiments of the invention, a fitting protecting apparatus of a developer cartridge and an image forming apparatus having the same will be described in detail referring to the accompanied drawings, as follows.

A wet-type electrophotographic printer employing a fitting protecting apparatus 200 of a developer cartridge according to an exemplary embodiment of the invention includes an image forming part (not shown) and a developer supply part 100.

Figure 1:
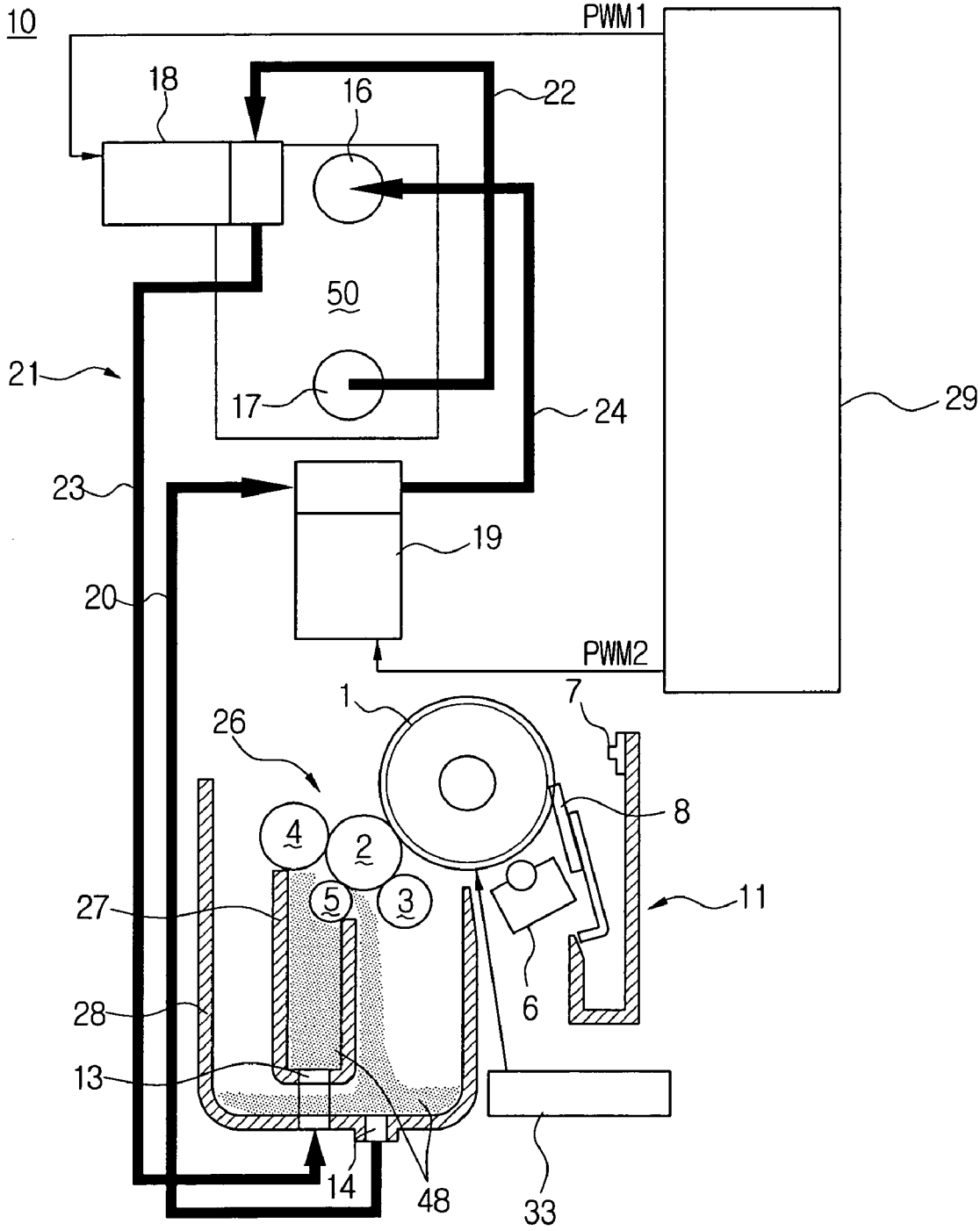
FIG. 1 (PRIOR ART)
FIG. 1 is a schematic representation of a conventional wet-type electrophotographic printer.
Figure 2:
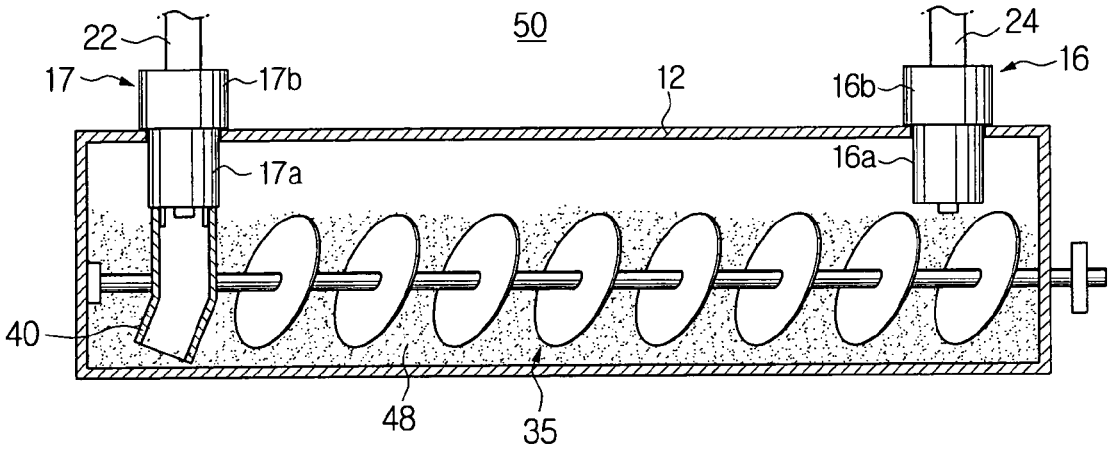
FIG. 2 (PRIOR ART)
FIG. 2 is a sectional view illustrating a developer cartridge of a wet-type electrophotographic printer shown in FIG. 1.

A configuration of an image forming part is similar to the configuration of the wet-type electrophotographic printer 10 described above referring to FIG. 1, thus its detailed description is omitted.

Figure 3:
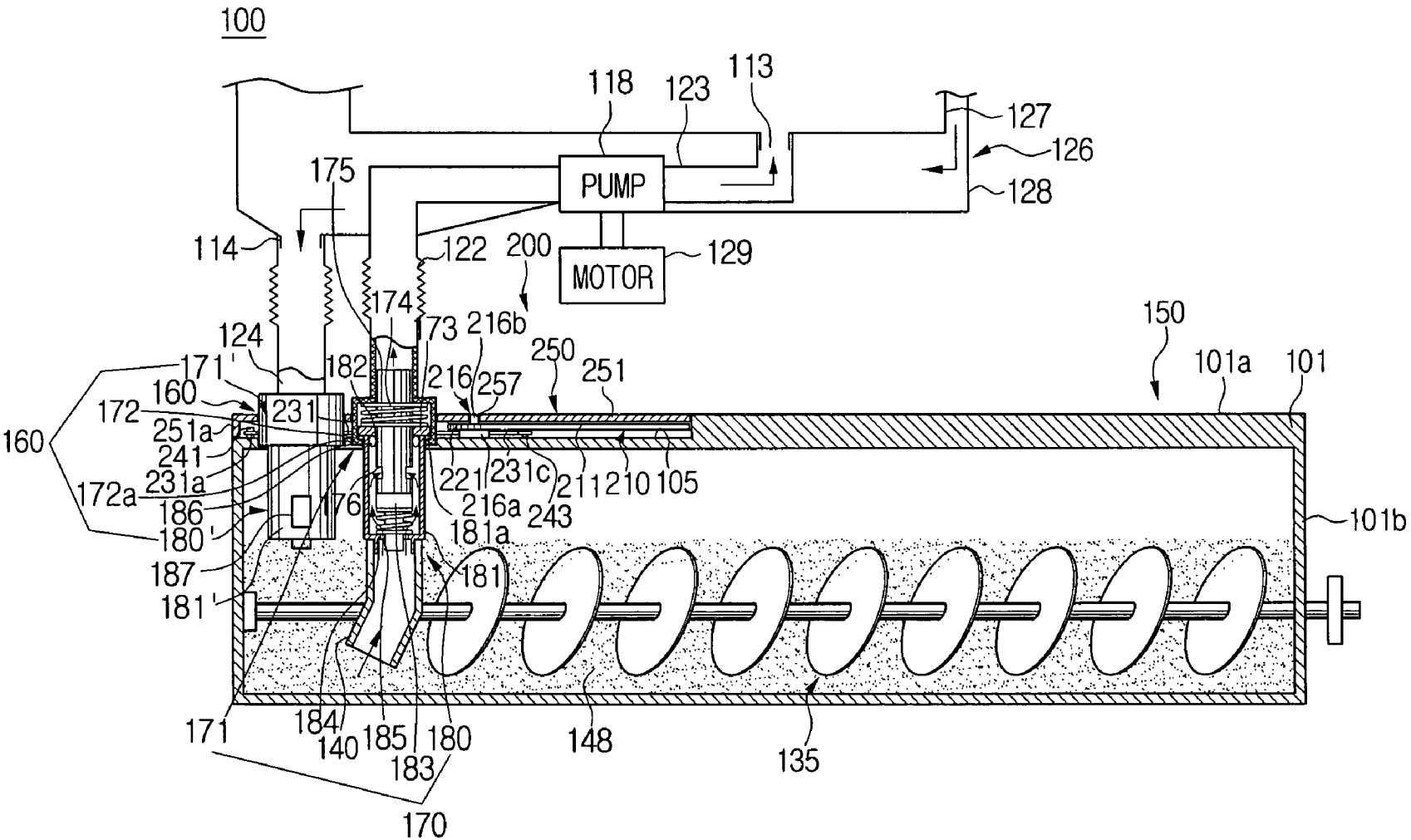
FIG. 3 is a schematic representation of a developer supply part of a wet-type electrophotographic printer employing a fitting protecting apparatus of a developer cartridge according to an exemplary embodiment of the present invention.

FIG. 3 illustrates a developer supply part 100 of a wet-type electrophotographic printer to which a fitting protecting apparatus 200 of a developer cartridge is applied.

The developer supply part 100 includes a developer cartridge 150 storing liquid developer 148, first and second connection tubes 122 and 123 for connecting the developer cartridge 150 to a developing chamber 127 of a developing part 126, a developer supply pump 118 disposed between the first and second connection tubes 122 and 123 and driven by a motor 129, and a third connection tube 124 for connecting the developer cartridge 150 to a recollection chamber 128 of the developing part 126.

Though it was exemplarily described above that the developer cartridge 150 is directly connected to the recollection chamber 128 of the developing part 126 through the third connection tube 124, the developer cartridge 150 may be installed over the recollection chamber 128. The developer cartridge 150 is connected to the recollection chamber 128 of the developing part 126 through third and fourth connection tubes 20 and 24 and a developer recollection pump 19 disposed therebetween, as in the printer 10 described with reference to FIG. 1.

The developer cartridge 150 includes a housing 101 provided as a developer storage spacer for storing liquid developer 148, and a liquid developer agitator 135 for agitating liquid developer 48 within the housing 101.

In a sidewall 101*b* of one end part of the housing 101, a handle 109 (FIG. 4) is disposed adapted to be grasped by a user. A concave part is formed on one side of a top plate 101*a* of the housing 101 near the sidewall 101*b* in which the handle 109 is disposed.

A first developer discharge part 170 and a first developer influx part 160 are disposed in the concave part 105. The first developer discharge part 170 and the first developer influx part 160 are spaced apart with a determined interval therebetween, and are preferably askew with respect to one another.

The first developer discharge part 170 is connected to a second developer influx part 113 of a developing chamber 127 through first and second connection tubes 122 and 123 to supply liquid developer 148 of the housing 101 to the developing chamber 127. The first developer influx part 160 is connected to a second developer discharge part 114 of the recollection chamber 128 of the developing part 126 through a third connection tube 124 to recollect the liquid developer 148 from the recollection chamber 128.

The first developer discharge part 170 includes a first female fitting 180 disposed in the concave part 105 of the top plate 101*a* of the housing 101 and a first male fitting 171 adapted in an end part of the first connection tube 122. The first male fitting 171 being opposite to and being connected to the first female fitting 180.

The first male fitting 171 is supported to be elastically engaged with a frame 107 (FIG. 4) of a printer body (not shown) by a well-known fitting elevator (not shown) operating in association with an open and close operation of an external cover (not shown) of the printer or operating by a sensor (not shown) for sensing an open and close operation of the external cover. Thus, when the external cover is opened to install the housing 101 on the frame 107 of the printer body or take it out of the frame 107, the first male fitting 171 is lifted by the fitting elevator and is then disconnected from the first female fitting 180. When the external cover is closed, the first male fitting 171 descends by the fitting elevator and is then connected to the first female fitting 180.

Though it was described herewith that the first male fitting 171 was connected to or disconnected from the first female fitting 180 by the fitting elevator, the first male fitting 171 may be adapted to be pressed and supported to a first female fitting 180 by an elastic member (not shown), such as an elastic spring. In this case, the first male fitting 171 is connected to or disconnected from the first female fitting 180 manually by a user.

The first female fitting 180 is sealed by an inventive fitting protecting apparatus 200, which is described below, when the housing 101 is taken out of the frame 107 of a printer body for maintenance of the developer cartridge 150 or during storage of the developer cartridge while not in use.

The first female fitting 180 includes a first female fitting tube 181 fixedly installed to the concave part 105, and a developer suction tube 140 extended from a lower part of the first female fitting tube 181 to a bottom of the housing 101.

A substantially T-shaped valve plate 183 is disposed within the first female fitting tube 181 of the first female fitting 180 and is elastically pressurized by a first elastic spring 184. When the first male fitting 171 is separated from the first female fitting 180, in which an internal connection tube 175 of the first male fitting 171 to be described later is removed from an upper aperture 182 of the first female fitting tube 181, the substantially T-shaped valve plate 183 together with a first packing member 186 of the upper aperture 182 seals the upper aperture 182. Thus, liquid developer 148 is prevented from being leaked from the developer suction tube 140 of the housing 101 through the upper aperture 182 of the first female fitting tube 181.

The first male fitting 171 includes a first male fitting tube 172 having an internal connection ring part 172*a* that is locked with an outer connection ring part 181*a* of the first female fitting tube 181 when the first male fitting 171 is connected to the first female fitting 180 in a lower part.

Within the first male fitting tube 172 of the first male fitting 171, an internal connection tube 175 and a second packing member 173 are disposed.

In an upper part, the internal connection tube 175 is connected to a first connection tube 122. In a lower part thereof, the internal connection tube 175 has a liquid developer suction aperture 176 for sucking liquid developer 148 flowing through a lower aperture 185 of the first female fitting tube 180.

A second packing member 173 is pressurized toward a lower side elastically by a second elastic spring 174. Thus, when the first male fitting 171 is separated from the first female fitting 180, the second packing member 173 is provided with a girth of the internal connection tube 175 to seal the liquid developer suction aperture 176 to substantially prevent leakage of the liquid developer 148 from the first connection tube 122 through the liquid developer suction aperture 176 of the internal connection tube 175.

That is, when the first female fitting 180 is connected with the first male fitting 171, the liquid developer 148 may be supplied from the developer suction tube 140 of the housing 101 to the first connection tube 122 through the lower aperture 185 of the first fitting tube 181 and the liquid developer suction aperture 176 of the internal connection tube 175.

The first developer influx part 160 includes a second female fitting 180' installed in the concave part 105 of the top plate 101*a* of the housing 101, A second male fitting 171' is installed in an end part of the third connection tube 124, and is substantially opposite to the second female fitting 180' to be connected to the second female fitting 180'.

Configuration and operation of the second female fitting 180' is substantially similar to the first female fitting 180 of the first developer supply part 170, except that a liquid developer discharge aperture 187 is provided at an outer circumferential face of the second female fitting tube 181' instead of the developer suction tube 140 being provided at a lower part thereof of the first female fitting 180 of the first developer discharge part 170. Configuration and operation of the second male fitting 171' is substantially similar to the first male fitting 171 of the first developer supply part 170.

As shown in FIGS. 3 through 5B, the fitting protecting apparatus 200 of the developer cartridge includes a cover part 210 for sealing or opening first and second female fittings 180 and 180' of a developer cartridge 150, and an operation part 220 operating the cover part 210 to seal or open the first and second female fittings 180 and 180'.

The cover part 210 includes a cover member 211 for covering the first and second female fittings 180 and 180' formed in the concave part 105. A support member 215 supports the cover member 211 for rotatable movement thereof in the concave part 105. The cover member 211 is supported by the support member 215 and rotates between a first position (FIG. 5A) and a second position (FIG. 5B). The first position seals the first and second female fittings 180 and 180' so as not to be exposed and the second position opens the first and second female fittings 180 and 180' to be exposed.

Figure 5A:
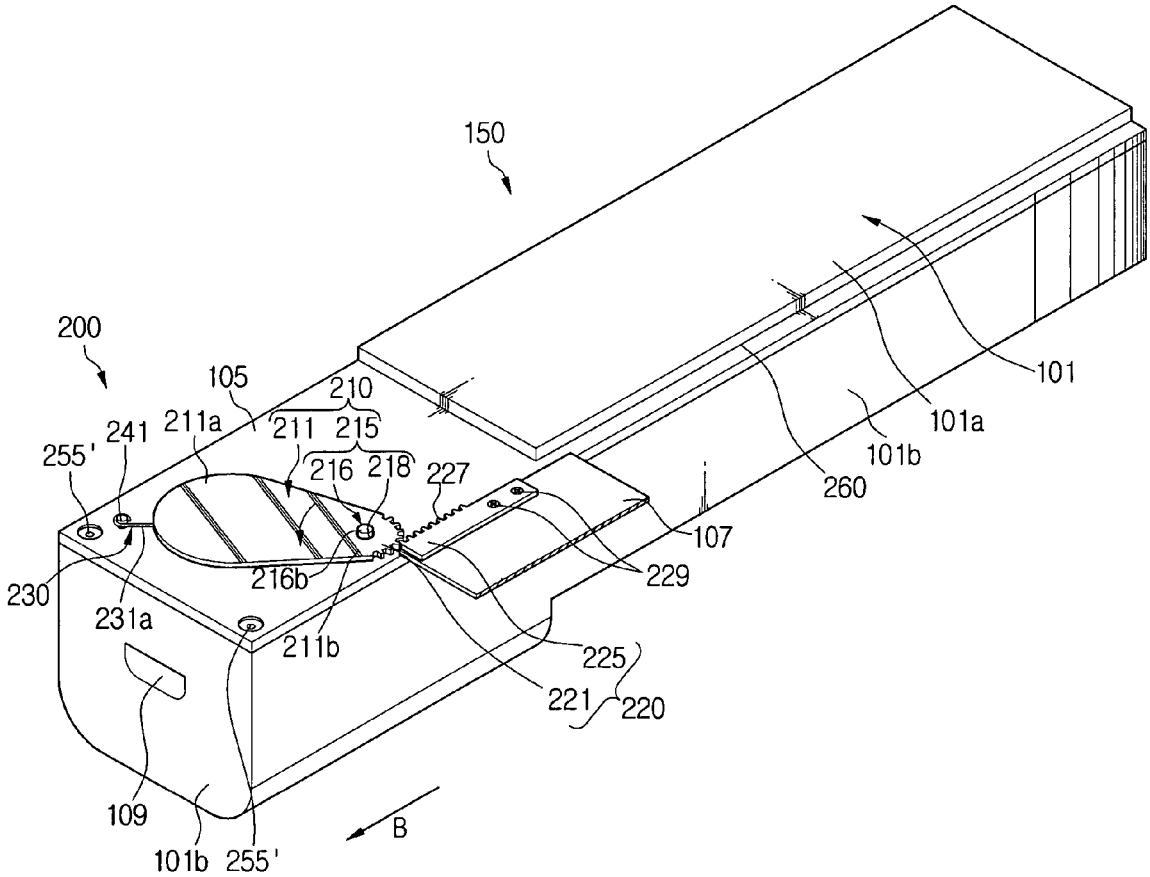
FIGS. 5A and 5B are perspective views of a fitting protecting apparatus of a developer cartridge according to an exemplary embodiment of the present invention.
Figure 5B:
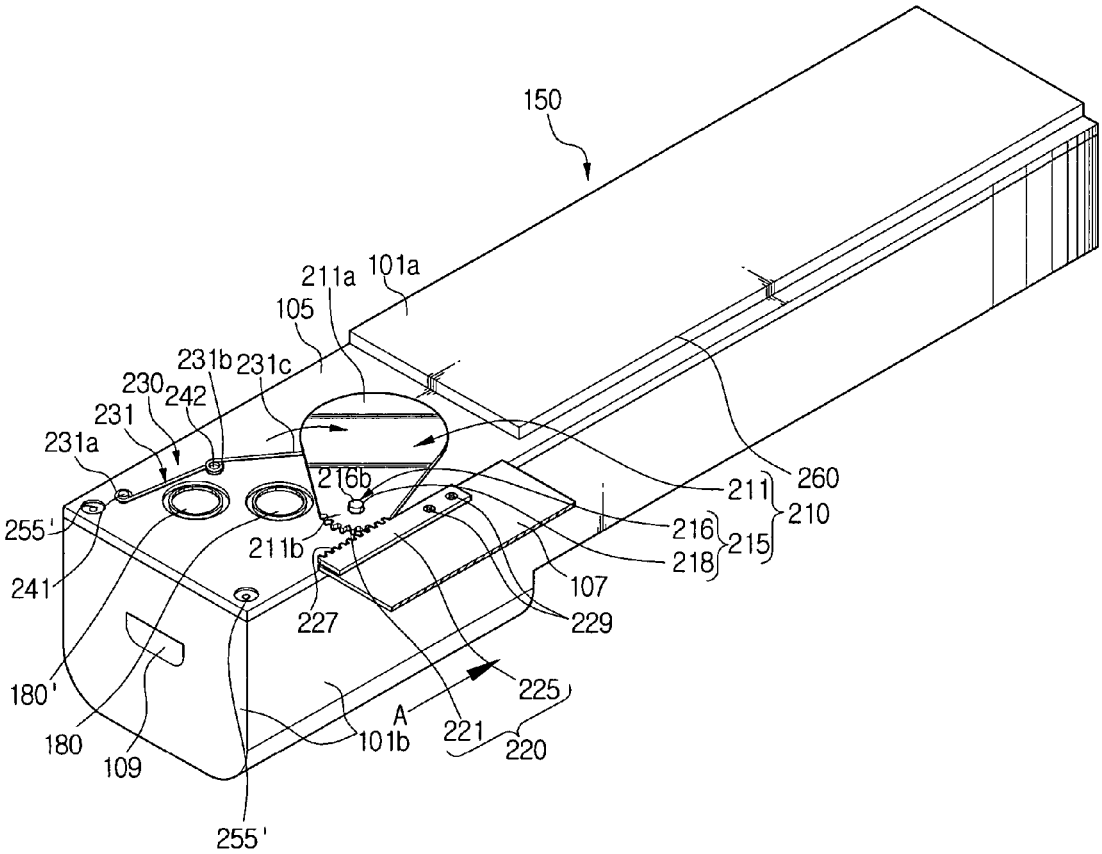

The cover member 211 is preferably formed in a longish oval plate larger than a flat area sum of the first and second female fittings 180 and 180' to cover the first and second female fittings 180 and 180', as shown in FIG. 5A. Preferably, the cover member 211 is substantially tear-drop shaped. The oval plate is constructed of an extension face 211*a* for covering the first and second female fittings 180 and 180', and a reduction face 211*b* in which a support axis hole 218 of the support member 215, which is described later, and a pinion gear 221 of the operation part 220 are formed.

The support member 215 is constructed of a support axis 216 formed near the first female fitting 180 in the concave part 105, and the support axis hole 218 in which the support axis 216 is inserted and supported. The support axis hole is formed in the reduction face 211*a* of the cover member 211.

The support axis 216 has a base 216*a* (FIG. 3) fixedly supported to the concave part 105, and an upper end part 216*b* supported in an aperture 257 (FIG. 4) formed in a square shape plate 251 of an exterior cover member 250 described later. The base 216*a* supports the cover member 211*a* predetermined distance from a bottom of the concave part 105, thus providing an operation space for a toggle spring 231 of a return part 230 and a second support boss 243 (FIG. 3) supporting a second end part 231*b* of the toggle spring 231.

The operation part 220 operates to move the cover member 211 of the cover part 210 between the first position and the second position when the developer cartridge 150 is installed in or taken out of the frame 107, or when first and second male fittings 171 and 171' are connected with or disconnected from the first and second female fittings 180 and 180'.

Figure 6:
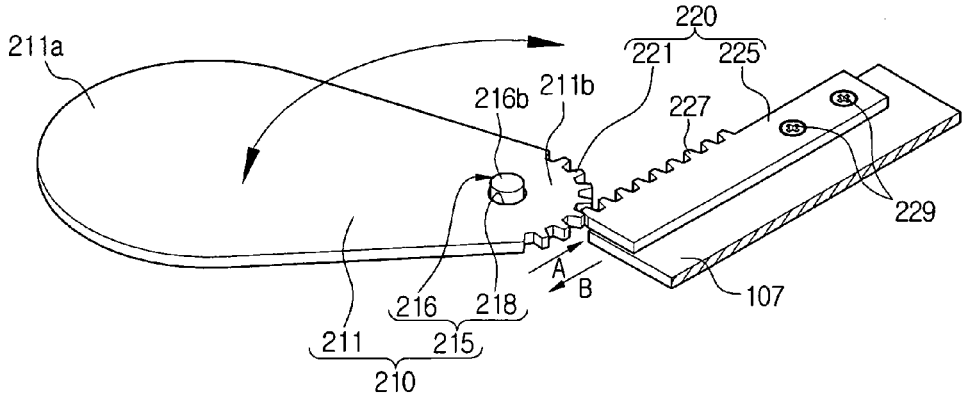
FIG. 6 is a perspective view of an operation part connected to a fitting protecting apparatus of a developer cartridge shown in FIG. 4.

Referring to FIG. 6, the operation part 220 includes a pinion gear 221 formed in an outer edge of the reduction face 211*b* of the cover member 211, and a rack member 225 having a rack gear 227 that engages the pinion gear 221 to rotate the cover member 211.

The rack member 225 is rigidly fixed to the frame 107 of the printer body through use of fixation members 229, such as screws. Thus, when the developer cartridge 150 is installed in or taken out of the frame 107 of the printer body, the rack member 225 rotates the pinion gear 221 engaging the rack gear 227 by using a movement force of the housing 101, thereby rotating the cover member 211 between the first position shown in FIG. 5A and the second position shown in FIG. 5B. The rack member 225 and the frame 107 are slidingly contact a slide flute 260 along an edge of one side of the housing top plate 101*a*.

Alternatively, the rack member 225 may be installed in the housing 101 to be slidable a predetermined distance along the slide flute 260 of the housing 101 when the rack gear 227 engages the pinion gear 221 instead of being fixed to the frame 107 of the printer body. In this case, when the housing 101 is installed in or taken out of the frame 107, or when the first and second male fittings 171 and 171' are connected with or disconnected from the first and second female fittings 180 and 180', the rack member 225 slides along the slide flute 260 by pushing or pulling force of a user, thus rotating the pinion gear 221 engaging the rack gear 227 and rotating the cover member 211 between the first and second positions.

As shown in FIGS. 3 and 5B, the fitting protecting apparatus 200 of the developer cartridge may further include a return part 230 for returning the cover member 211 of the cover part 210 from the second position (FIG. 5B) to the first position (FIG. 5A) when the housing 101 is taken out of the frame 107, or when the first and second male fittings 171 and 171' are disconnected from the first and second female fittings 180 and 180'.

The return part 230 has a toggle spring 231 in which a center part 231*b* is movably supported to a fixation boss 242 formed in the concave part 105 of the housing 101 in the vicinity of the second female fitting 180'. One end part 231*a* of the toggle spring 231 is supported to the first support boss 241 formed in the vicinity of the second female fitting 180' distanced from the fixation boss 242. Another end part 231*c* is supported to a second support boss 243 (FIG. 3) formed in a lower face of the extension face 211*a* of the cover member 211.

Alternatively, the return part 230 may be constructed of a compression spring (not shown) in which a center part is rotatably supported by the support axis 216 of the support member 211 instead of having the toggle spring 231 rotatably supported by the fixation boss 242. In this case, one end part of the compression spring is supported to a first support boss (not shown) formed in the concave part 105 and another end part is supported to a second boss (not shown) formed in a lower face of the extension face 211*a* of the cover member 211.

Figure 4:
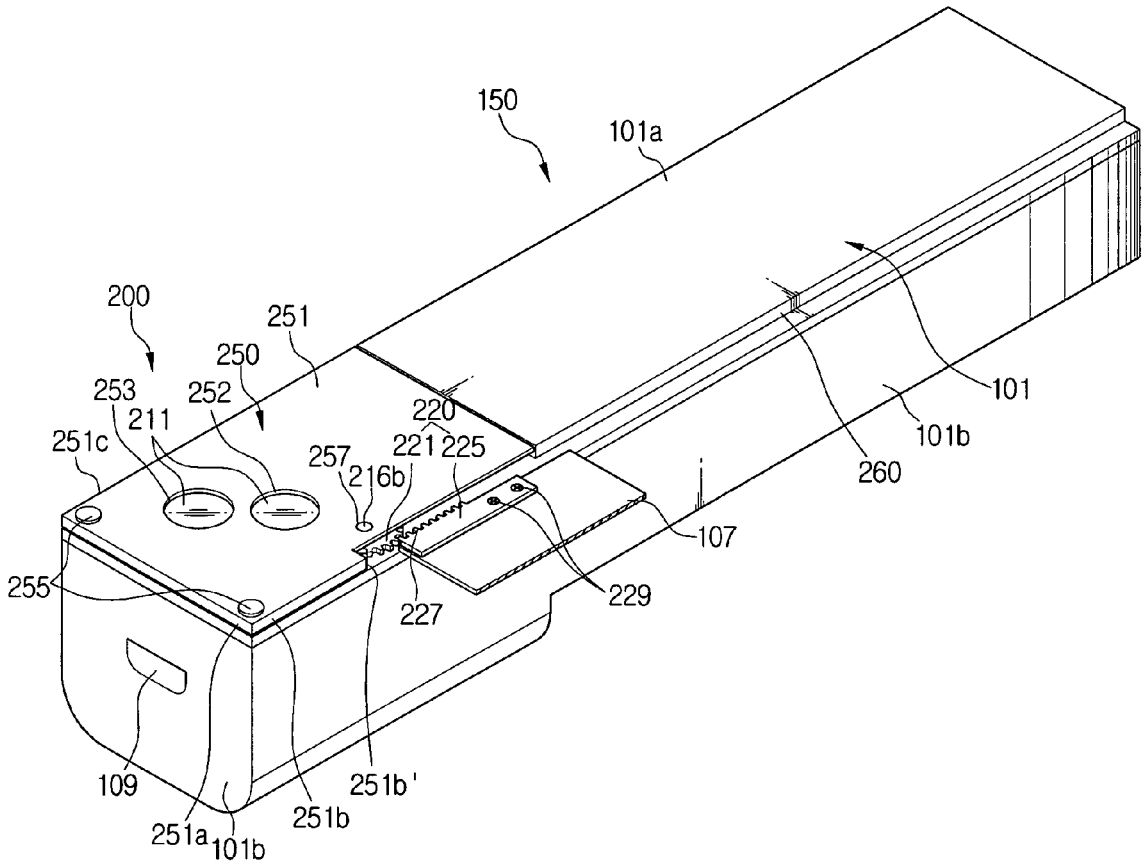
FIG. 4 is a perspective view of a fitting protecting apparatus of a developer cartridge shown in FIG. 3.

With reference to FIGS. 3 and 4, the fitting protecting apparatus 200 of the developer cartridge further includes an exterior cover member 250 for sealing up the concave part 105 of the housing 101 in which the cover part 210 and the return part 230 are installed so as not to expose it.

The exterior cover member 250 is constructed of a square shape plate 251 having first, second and third protrusion edges 251*a*, 251*b* and 251*c*, which extend a predetermined height toward the concave part 105 to provide the installation and operation space for the toggle spring 231 of the return part 230 and the cover member 211 on the concave part 105 of the housing 101.

The square shape plate 251 is fixed to a corresponding fixation part 255' of the concave part 105 through a fixation member 255 such as screw.

In the square shape plate 251 near the second protrusion edge 251*b*, a cut open part 251*b* is formed to be connected with the slide flute 260. The cut open part 251*b* exposes the pinion gear 221 of the operation part 220 formed in the reduction face 211*b* of the cover member 211 to the outside and provides a space in which the rack member 225 of the operation part 220 may slide.

The square shape plate 251 has first and second circular apertures 252 and 253 for exposing the first and second female fittings 180 and 180' in the outside. The first and second circular apertures 252 and 253 are formed corresponding to the first and second female fittings 180 and 180' so that the first and second male fittings 171 and 171' are connected with the first and second female fittings 180 and 180'.

As described above, the exterior cover member 250 seals the cover part 210 and the return part 230 to prevent exposing them, thereby components of the printer body, including the first and second male fittings 171 and 171', are prevented from being contacted with the toggle spring 231 of the return part 230 and the cover member 211 when the developer 150 is installed in or taken out of the frame 107.

Figure 7:
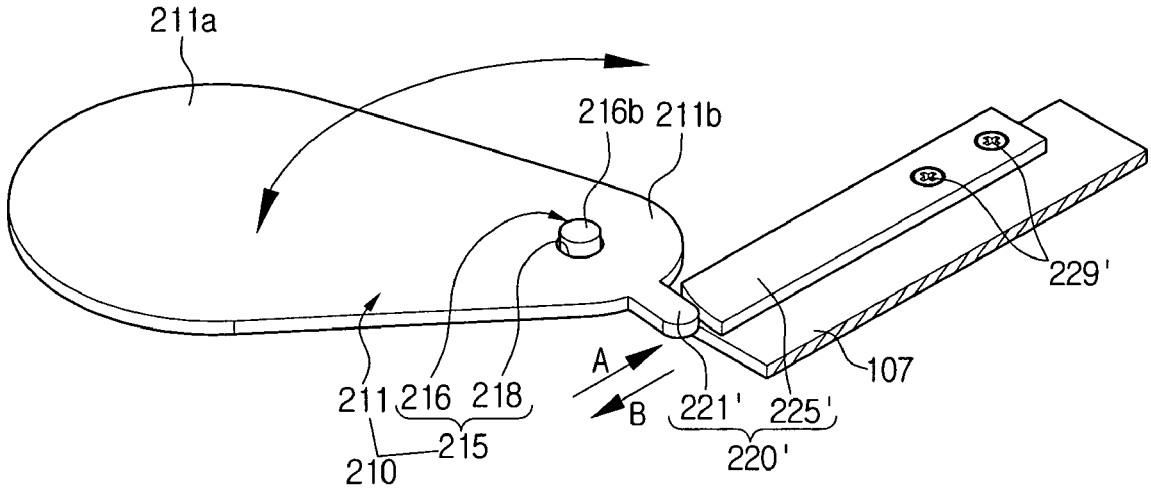
FIG. 7 is a perspective view of an operation part connected to a fitting protecting apparatus of a developer cartridge shown in FIG. 4.

Though it was above exemplarily described in the fitting protecting apparatus 200 of the developer cartridge that the operation part 220 has the pinion gear 221 and the rack member 225 having the rack gear 227; as shown in FIG. 7, the operation part may be constructed of a protrusion 221' formed in an outer edge of the reduction face 211*b* and a corresponding protrusion member 225' that extends toward the protrusion 221' to engage the protrusion 221'.

Though it was described above exemplarily that the fitting protecting apparatus 200 of the developer cartridge 150 had the first and second female fittings 180 and 180' formed on the top plate 101*a* of the housing 101; the invention is not so limited. For example, if one of the first and second female fittings 180 and 180' is installed in the top plate 101*a* of the housing 101 and another is installed in a sidewall 101*b*, it may be configured to cover only the female fitting installed in the top plate 101*a*.

As described above, the fitting protecting apparatus 200 of the developer cartridge according to an exemplary embodiment of the invention seals the first and second female fittings 180 and 180' when the housing 101 is taken out of the frame 107 of the printer body for maintenance of the developer cartridge 150 or while the developer cartridge is being stored, thereby preventing a user from being exposed to developer and other components from being polluted secondarily through the first and second female fittings 180 and 180'. In addition, the first and second female fittings 180 and 180' are prevented from being polluted with foreign substances and debris, such as dust, or from being damaged by an external collision.

An operation of a wet-type electrophotographic printer having such a fitting protecting apparatus 200 of a developer cartridge will be described referring to FIGS. 3 through 6.

First, an operation of installing the developer cartridge 150 in the frame 107 of the printer body is described.

When an external cover is opened to install a developer cartridge 150 in a frame 107 of the printer body, first and second male fittings 171 and 171' are lifted to a position not obstructing a movement of the developer cartridge 150, through a fitting elevator operating in association with an open and close operation of the external cover.

Subsequently, the developer cartridge 150 is caught by a handle 109 of a housing 101 and then is pushed in a direction indicated by arrow A into the frame 107 of the printer body, as shown in FIGS. 5B and 6.

At this time, in the developer cartridge 150, as shown in FIGS. 4 and 5A, a cover member 211 is positioned on a first position of sealing up first and second apertures 252 and 253 of a square shape plate 251 to substantially prevent exposing first and second female fittings 180 and 180', particularly when the developer cartridge is not installed in the printer.

When the housing 101 is inserted a predetermined distance into the frame 107 of the printer body, a pinion gear 221 disposed on a reduction face 211*b* of the cover member 211 engages a rack gear 227 of a rack member 225 fixed to the frame 107, thereby rotating the cover member 211 clockwise about a support axis 216 and against an elastic force of toggle spring 231 of a return part 230.

When the housing 101 is completely installed in the frame 107, as shown in FIG. 5B, the cover member 211 is moved from a first position to a second position, and the first and second apertures 252 and 253 of the exterior cover member 250 are accessible.

At this time, the first and second female fittings 180 and 180' are positioned under first and second male fittings 171 and 171' that are lifted by a fitting elevator.

Next, when the external cover is closed, the first and second male fittings 171 and 171' descend by the fitting elevator operating in association with an open and close operation of the external cover and are then inserted into the first and second apertures 252 and 253. After that, as shown in FIG. 3, as internal connection ring part 172*a* of first and second male fitting tubes 172 are locked with an outer connection ring part 181*a* of the first and second female fitting tubes 181 and 181', the first and second male fittings 171 and 171' are connected respectively with the first and second female fittings 180 and 180'.

That is, in each of the first and second male fittings 171 and 171', a second packing member 173 is pushed up by first and second female fitting tubes 181 and 181' to open a liquid developer suction aperture 176 of an internal connection tube 175. In each of the first and second female fittings 180 and 180', a substantially T-shaped valve plate 183 is pushed up into the interior of the first and second female fitting tubes 181 and 181' by the internal connection tube 175.

Thus, liquid developer 148 is supplied from a developer suction tube 140 of the housing 101 to a first connection tube 122 through a lower aperture 185 of the first female tube 181 and a liquid developer suction aperture 176 of the internal connection tube 175, or is recollected from a third connection tube 124 to the interior of the housing 101 through the liquid developer suction aperture 176 of the internal connection tube 175, the lower aperture 185 of the second female fitting tube 181' and a liquid developer discharge aperture 187.

An operation of removing the developer cartridge 150 from the frame 107 of the printer body will be described as follows.

Referring back to FIG. 3, when an external cover is opened, the first and second male fittings 171 and 171' are disconnected from the first and second female fittings 180 and 180' by a fitting elevator operating in association with an open and close operation of the external cover, and are then lifted toward the outside of the first and second apertures 252 and 253 of the exterior cover member 250.

In this state, the housing 101 of the developer cartridge 150 is taken out of the frame 107 by a handle 109 being pulled by a user in a direction indicated by arrow B, as shown in FIGS. 5A and 6.

When the housing 101 is taken out of the frame 107, the cover member 211 is rotated counterclockwise by a pinion gear 221 engaging a rack gear 227 of a rack member 225 to move the cover member 211 from a second position shown in FIG. 5B to a first position shown in FIG. 5A. Hence, as shown in FIG. 4, the first and second apertures 252 and 253 of the exterior cover member 250 are sealed by the cover member 211.

At this time, a toggle spring 231 of the return part 230 helps the cover member 211 move to a first position. After the cover member 211 reaches the first position, the toggle spring substantially maintains the cover member in the first position.

Then, when the housing 101 is removed from the frame 107, the operation of taking out the developer cartridge 150 from the frame 107 of the printer body is completed.

As described above, in a fitting protecting apparatus of a developer cartridge and an image forming apparatus having the same according to an exemplary embodiment of the invention, female fittings connected to male fittings of connection tubes are sealed and protected when the developer cartridge is taken out of a main body of the image forming apparatus for maintenance or while being stored. Developer exposure through the female fittings is substantially prevented. Pollution of female fittings with foreign substances and debris, such as dust, and damage of female fittings by an outside collision are also substantially prevented. That is, when dealing with a developer cartridge, a user's secondary pollution of components through developer exposure, image-quality deterioration through pollution of liquid developer, and leakage of liquid developer may be prevented.

Additionally, in a fitting protecting apparatus of a developer cartridge and an image forming apparatus having the same according to an exemplary embodiment of the invention, an operation part operating a cover part has a simplified structure of operating by using a movement force provided when a developer cartridge is installed in or taken out of a main body, or manually by a force exerted by a user, thereby providing an easy operation without obstructing a connection or disconnection operation between male fittings and female fittings.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A fitting protecting apparatus of a developer cartridge, comprising:

a housing storing liquid developer, the housing having at least one connection fitting adapted to connect to a corresponding connection fitting;

a cover part movable between a first position of covering the connection fitting to substantially prevent exposure and a second position uncovering the connection fitting to provide access thereto, the cover part being disposed in the housing and pivotable about a connection to the housing; and an operation part moving the cover part between the first and second positions.

2. The apparatus of claim 1, wherein a cover member covers the connection fitting; and a support member supports the cover member to the housing and facilitates the cover member rotatably moving between the first position and the second position.

3. The apparatus of claim 2, wherein the cover member has a plate larger than a flat area of the connection fitting, and the support member has a support axis fixed to the housing, and the cover member has a support axis hole adapted to receive the support axis.

4. The apparatus of claim 2, wherein a pinion gear is formed in one end part of the cover member; and a rack member having a rack gear adapted to engage the pinion gear to rotate the cover member.

5. The apparatus of claim 4, wherein the rack member is rigidly fixed to a main body of an image forming apparatus.

6. The apparatus of claim 4, wherein the rack member is movably installed in the housing.

7. The apparatus of claim 2, wherein a protrusion is formed in one end part of the cover member, and a corresponding protrusion member is adapted to engage the protrusion to move the cover member.

8. The apparatus of claim 2, wherein a return part returns the cover member of the cover part from the second position to the first position.

9. The apparatus of claim 8, wherein the return part has an elastic spring installed in the housing, one end part being supported by a first support boss formed in the housing and another end part being supported by a second support boss formed in the cover member.

10. The apparatus of claim 8, wherein the return part has an elastic spring installed in the support member, one end part being supported by a first support boss formed in the housing and another end part being supported by a second support boss formed in the cover member.

11. The apparatus of claim 8, wherein an exterior cover member covers the cover part and the return part to prevent exposing the cover part and the return part, the exterior cover member being installed in the housing.

12. The apparatus of claim 11, wherein the exterior cover member has an aperture exposing the connection fitting to connect the corresponding connection fitting to the connection fitting.

13. An image forming apparatus, comprising:

an image forming part having a developing part forming an image by using liquid developer; and a developer cartridge having a housing that has at least one connection fitting connected to a corresponding connection fitting of at least one connection tube that is connected to the developing part to supply the liquid developer to the developing part, wherein the developer cartridge includes a cover part disposed in the housing adapted to be moved between a first position covering the connection fitting to prevent exposing the connection fitting and a second position of uncovering the connection fitting to provide access thereto, and a fitting protecting part having an operation part to move the cover part between the first and second positions and that covers the connection fitting, the cover part being pivotable about a fastening connection to the housing.

14. The apparatus of claim 13, wherein a cover member covers the connection fitting; and a support member supports the cover member to the housing and facilitates rotatably moving the cover member between a first position and a second position.

15. The apparatus of claim 14, wherein the cover member has a plate larger than a flat area of the at least one connection fitting; and the support member has a support axis fixed to the housing, and the cover member has a support axis hole adapted to receive the support axis.

16. The apparatus of claim 14, wherein a pinion gear is formed in one end part of the cover member; and a rack member has a rack gear adapted to engage the pinion gear to rotate the cover member.

17. The apparatus of claim 16, wherein the rack member is rigidly fixed to a main body of an image forming apparatus.

18. The apparatus of claim 16, wherein the rack member is movably connected to the housing and adapted to move a predetermined distance in the housing.

19. The apparatus of claim 14, wherein a protrusion is formed in one end part of the cover member, and a corresponding protrusion member is adapted to engage the protrusion to rotate the cover member.

20. The apparatus of claim 14, wherein the fitting protecting part has a return part adapted to return the cover member of the cover part from a second position to a first position.

21. The apparatus of claim 20, wherein the return part has an elastic spring installed in the housing, one end part being supported by a first support boss formed in the housing and another end part being supported by a second support boss formed in the cover member.

22. The apparatus of claim 20, wherein the return part has an elastic spring installed in the support member, one end part being supported by a first support boss formed in the housing and another end part being supported by a second support boss formed in the cover member.

23. The apparatus of claim 20, wherein the fitting protecting part has an exterior cover member installed in the housing to cover the cover part and the return part to prevent the cover part and the return part from being exposed.

24. The apparatus of claim 23, wherein the exterior cover member has an aperture adapted to expose the connection fitting to connect the corresponding connection fitting to the connection fitting.

* * * * *